United States Patent [19]

Cobbs, Jr.

[11] Patent Number: 4,730,556

[45] Date of Patent: Mar. 15, 1988

[54] METHOD OF SCREEN PRINTING WITH HOT MELT FOAM COMPOSITIONS

[75] Inventor: Walter H. Cobbs, Jr., Amherst, Ohio

[73] Assignee: Nordson Corporation, Cleveland, Ohio

[21] Appl. No.: 791,892

[22] Filed: Oct. 28, 1985

[51] Int. Cl.[4] ..... B41M 1/12

[52] U.S. Cl. ..... 101/129; 8/477; 101/120; 101/114; 118/213; 427/282

[58] Field of Search ..... 101/114, 129, 120, 123; 8/477; 427/272, 282, 244; 118/213, 406

[56] References Cited

U.S. PATENT DOCUMENTS

| | | | |
|---|---|---|---|
| 966,174 | 8/1910 | Dezavis | 101/114 |
| 2,731,912 | 1/1956 | Welsh | 101/129 |
| 2,971,458 | 2/1961 | Kumins . | |
| 3,084,661 | 4/1963 | Roberts . | |
| 3,275,494 | 9/1966 | Brunson et al. | 161/33 |
| 3,294,532 | 12/1966 | Brunson et al. | 96/27 |
| 3,399,165 | 8/1968 | Berger et al. | 260/41 |
| 3,482,300 | 12/1969 | Reinke | 39/160 |
| 3,577,915 | 5/1971 | Thompson et al. | 101/129 |
| 3,656,428 | 4/1972 | Duncan | 101/129 |
| 3,759,799 | 9/1973 | Reinke | 204/16 |
| 4,018,728 | 4/1977 | Priest | 260/17 |
| 4,059,466 | 11/1977 | Scholl et al. | 156/78 |
| 4,156,754 | 5/1979 | Cobbs, Jr. et al. | 428/310 |
| 4,247,581 | 1/1981 | Cobbs, Jr. et al. | 427/373 |
| 4,301,119 | 11/1981 | Cobbs, Jr. et al. | 422/133 |
| 4,371,096 | 2/1983 | Scholl . | |
| 4,527,712 | 7/1985 | Cobbs, Jr. et al. | 222/1 |

FOREIGN PATENT DOCUMENTS

| | | | |
|---|---|---|---|
| 2402353 | 7/1975 | Fed. Rep. of Germany | 8/477 |
| 74670 | 6/1977 | Japan | 8/477 |
| 58085 | 5/1978 | Japan | 8/477 |
| 120460 | 7/1984 | Japan | 101/120 |

*Primary Examiner*—Clyde I. Coughenour

*Attorney, Agent, or Firm*—Wood, Herron & Evans

[57] ABSTRACT

The method of screen printing with a hot melt foam composition includes providing a screen having the desired pattern to be transferred to a substrate, casting onto the screen a hot melt foam composition and forcing the foam composition through the screen to form the described pattern on the substrate. The method offers a number of advantages including the transfer of large amounts of hot melt inks through the screen, fast printing speeds, printing with highly viscous polymeric or thermosetting materials and control of processing temperatures, among other advantages.

10 Claims, No Drawings

METHOD OF SCREEN PRINTING WITH HOT MELT FOAM COMPOSITIONS

BACKGROUND OF THE INVENTION

Screen printing processes employing thermoplastic inks or hot melts are well known. An early example of such a method is disclosed in U.S. Pat. No. 2,731,912 issued to Welsh wherein a process is described for screen printing or decorating objects such as ceramic ware by heating a thermoplastic color compound and forcing it through a screen having a pattern to deposit a design onto the ceramic surface. Another example of such a screen printing process is disclosed in U.S. Pat. No. 3,577,915 issued to Thompson et al wherein specific thermoplastic polyethylene ink compositions are employed and such compositions are forced through a heated screen to permit the viscous thermoplastic polyethylene to satisfactorily pass through the screen. It is common in such screen printing processes for a hot thermoplastic ink to be forced through a heated screen. The hot screen has nonporous areas that prevent the hot melt ink from going through the screen and porous areas that allow the ink to go through the screen. The porous area of the screen represents the design or letters to be transferred. The screen is manufactured from a material, such as metal wire mesh, that is able to withstand temperatures above the melting point of the hot melt ink. As the printing screen is placed into contact with the substrate to be imaged, the hot melt ink is forced through the screen and the ink solidifies upon the substrate. Mechanical means can be used to aid the thermoplastic ink to flow through the screen. For instance, rollers, squeegees, and the like, have been used to transfer a thin printing film of hot melt onto the substrate through the screen. The printed surface is then removed from the screen and another blank surface to be imaged is placed in contact with the screen on a continuous basis, for instance by employing a rotary screen apparatus, and the cycle is repeated.

Other examples of hot melt printing inks and methods of use in hot melt screen printing include U.S. Pat. Nos. 3,275,494; 3,294,532; 3,399,165 and 4,018,728. These patents are merely representative and by their listing here it is not represented that they are the most pertinent prior art.

A number of process considerations must be taken into account in order to obtain satisfactory results with hot melt ink screen printing. For instance, the hot melt ink must remain at a temperature above its melting point during the operation in order to possess sufficient viscosity characteristics to flow properly through the porous portions of the screen. Printing temperatures are extremely important because certain ink compositions such as heat sensitive or thermosetting hot melts tend to cross-link or are otherwise adversely affected by high temperature. This usually requires either operation at very controlled temperatures or coarse screens are desired in order to permit a fast transfer of the hot melts through the screens during the printing process. Such coarse screens obviously affect the type of image and thus, fine images are not capable of being achieved with such coarse screens. In addition to the control of process conditions, a number of problems frequently occur. For instance, if the printing temperatures are not able to be safely maintained, high ink viscosities are usually encountered and poor printing results because the ink is not sufficiently thin to flow through the porous screen.

On the other hand, if low viscosities are achieved, the ink will flow too freely and poor printing results. Frequently, upon operating at high temperatures, cross-linking of polymeric inks causes plugging of the screen and, of course, this adversely affects the ability to print as well as the resulting images. Frequently the screens themselves must be heated in order to permit the hot melt inks to flow-through the printing screen. Such processes require screens, therefore, which resist destruction by heating. Such a limitation restricts the printing process because certain screen materials control the screen pore size which in turn affects the quality of the printing.

The demand for higher quality and high performance inks has placed more severe constraints upon the processing of hot melt inks. For instance, even where it would be desirable to use a polymeric ink because of its resistance to physical or chemical attack for a number of end uses, it has in the past been impractical if not impossible to screen print with a highly viscous polymeric material. Such a material with a high viscosity is not capable of being processed through a screen with any degree of precision in order to provide quality printing. Thus, while there are high performance thermoplastic or thermosetting compositions which would very desirably be employed as potential inks in screen printing, their use has been prevented because screen printing processes and techniques are not available to handle such high performance and high viscosity inks. It would be very desirable to provide a process whereby such high performance and high quality thermoplastic and thermosetting materials may be employed for screen printing to meet the demands of industry today.

It will be appreciated by a person of ordinary skill in this art that the screen printing industry, particularly as it pertains to printing with hot melt thermoplastic compositions, is in need of further improvements. Against the brief background of prior art presented above, there are a number of process parameters which make it difficult to control the printing process with hot melts and limit the nature of the thermoplastic inks which have been employed. Further improvements are needed in order to utilize a broader class of thermoplastic and thermosetting ink compositions at such speeds which render the screen printing process economical. It would be very desirable to provide screen printing processes which involve faster ink penetration and flow-through of thermoplastic melts and yet enable fast set characteristics consistent with printing operations. In view of the high cost of certain desirable polymers, quality printing is desired with the least amount of ink transferred through the screen. Consideration of all the above factors leads to the conclusion that further improvements in the screen printing of hot melt compositions are needed.

SUMMARY OF THE INVENTION

This invention is directed to a method of screen printing a pattern onto a substrate with a hot melt ink or thermoplastic composition. According to the method of this invention, the hot melt composition is first formed into a foamed state prior to being cast onto the printing screen and thereafter the foamed composition is forced through the screen to form a pattern on a substrate according to the screen image configuration.

The method of this invention affords a number of advantages and overcomes problems which have been associated with the prior art techniques as delineated in the above background. In particular, a stable foam of a thermoplastic hot melt is first formed. Such a stable foam is formed by introducing into a hot melt composition a gas or foaming agent to provide a dispersion of gas bubbles for the purpose of achieving a foam having time stability, and to allow pumping, dissolving, flow transfer, dispensing and printing. Hot melt foam compositions are known and widely developed for uses in coating processes as disclosed in U.S. Patents commonly assigned to the assignee of this invention including: U.S. Pat. Nos. 4,059,466; 4,156,754; 4,247,581; 4,301,119 and 4,527,712. It has been found in accordance with the principles of this invention that such stable hot melt foam compositions can be cast onto a printing screen and large amounts of the thermoplastic ink are transferred through the screen to provide quality printing. In particular, highly viscous polymeric compositions of a thermoplastic or thermosetting nature which otherwise would only transfer with difficulty, if at all, through a printing screen are indeed transferred quite readily by employing the hot melt foam technique of this invention.

The method of this invention allows for fast passage of polymeric ink material through a printing screen because of lower ink viscosities that are achieved by the hot melt ink in its foamed state under the shear stress of transfer through the screen by squeegeeing, for instance. Thus, highly viscous and thermosetting inks are readily handled according to the method of this invention because of such speed and control with which such inks may be processed. This invention also affords the use of high performance inks which otherwise are not capable of currently being employed in screen printing techniques. For instance, the air or gas-containing cells of the foam act as insulative barriers to prevent the escape of heat and otherwise consequent solidification of the liquid printing ink. The longer "open" time of the hot melt foam ink over the same unfoamed hot melt ink results from the small air or gas-containing cells of the foam acting as an insulative barrier to prevent the escape of heat. The ability to control the ink properties during printing by virtue of its foamed state is highly desirable and afforded by the method of this invention. In addition, stable hot melt foams enable the transfer of lesser amounts of ink without sacrificing the quality of the printed product. These objectives and other advantages of this invention will be understood with reference to the following detailed description.

DETAILED DESCRIPTION OF THE INVENTION

The hot melt foam compositions for use in the screen printing method according to this invention comprise liquid printing film-forming or polymeric components. Thus, the polymeric component may range from a liquid, to a semi-solid paste, to solid under normal conditions. The foams, in their hot melt liquid state, may contain either thermoplastic or thermosetting resinous compositions. Thermosetting resin compositions are used in the practice of this invention whereas heretofore such compositions because of high viscosities or heat sensitivities have been prevented from being employed in prior art techniques. Thus, this invention enables thermosetting ink compositions to be printed and cured or cross-linked to a high molecular weight state, thereby resisting solvent attack and the like. According to the printing process of this invention, such thermosetting components may be employed in the formation of the foam and, even though polymerization is occurring during periods of foaming, conveyance and transference through the printing screen to the printed surface, the foam state still permits processing the ink to a finished printed image on the substrate.

In order to provide a hot melt foam ink composition, the film-forming polymer can be obtained by melting with or without the addition of solvents or other liquid diluents and additives such as pigments or colors. The foam is formed in the hot melt state with known blowing agents, such as solids, gases or liquids. Common ink resins of the industrial coatings industry without solvents are suitable including polyacrylates and copolymers thereof, alkyd resins, polyester resins, polyurethanes, epoxies, coating grade polyurethanes, ethylene vinylacetate copolymers, polyvinyl chlorides, various rubber compositions and the like. Ink resins also used are alkyd polyester resins or polyesters. In this regard, the term "alkyd polyester" resin is intended to include those resins which are modified polyester resins, usually oil modified resins. And "polyester resins" are the synthetic resins derived from polyfunctional alcohols and acids. Other similar resins delineated hereinafter may be used in the hot melt inks.

Therefore, it is to be understood that the film-forming component of the hot melt ink compositions of this invention include a wide variety of polymeric components of the type just mentioned and well understood by those skilled in the art of hot melt inks. The principal polymeric composition which may be employed in any of the methods defined above depends upon the end use of the ink, the ink method employed, and so forth as will be well understood to a person of ordinary skill in the art.

The term "ink" is the generic term for many of the hot melt compositions that are employed in the practice of screen printing. Such compositions are perhaps more commonly referred to as flexible enamels, synthetic enamels, fast-dry enamels, flexible lacquers, industrial lacquers, flat vinyl ink, vinyl half-tone ink, fluorescent vinyl ink, gloss vinyl ink, satin vinyl ink, flock adhesive, transparent ink, acrylic ink, plastisol ink, Mylar ink, textile ink, among many other types of inks. For general information of ink compositions, reference may be had to the catalog by KC Graphics, In. 1978-1979, copyright 1978 by KC Graphics, Inc. Reference may also be had to "Textile Screen Printing" by Albert Kosloff, Second Edition, International Standard Book Number 0-911380-39-6 (1976). These sources will also serve as background information for inks. The printing screen may be made from a number of materials and may have various mesh sizes. A mono-filament screen is a single strand of material for example of polyester, nylon, stainless steel, silk, chrome-plated wire, or other things, which is woven into a specific number of squares per a dimension, i.e., a 230 mesh means 230 open squares per square inch. A multi-filament screen is comprised of a series of strands of similar materials just mentioned, braided before weaving into the mesh measurement, i.e., 12xx150 mesh would mean 12 interwoven strands subsequently woven into 150 open squares per square inch. U.S. Pat. Nos. 2,731,912; 2,753,794; 3,482,300; 3,557,195; 3,656,428 and 3,759,799 are all directed to printing screens, primarily metal or other durable screens, which may be employed in accordance with the principles of this invention. The disclosures of these patents are incorporated herein by reference insofar as they pertain to suitable printing screens which may be imaged in accordance with practices well understood in the art for use in this invention.

A "thermoplastic ink material", as that term is used and understood to those skilled in the art, includes any natural or synthetic thermoplastic polymer or polymeric compositions. As also used in this description, the term "thermoplastic hot melt ink" or "hot melt ink" or simply "hot melt" is a term which is well known in the art and this material has the same characteristics of liquification upon heating and upon cooling, solidification to a solid, semisolid or tacky state. In addition to the specific polymers listed above, other examples of thermoplastic ink materials include polyolefin polymers of ethylenically unsaturated monomers, such as polyethylene, polypropylene, polybutylenes, polystyrenes, poly ($\alpha$-methyl styrene), polyvinyl chloride, polyvinyl acetate, polymethyl methacrylate, polyethyl acrylate, polyacrylonitrile and the like; copolymers of ethylenically unsaturated monomers such as copolymers of ethylene and propylene, ethylene and styrene, and polyvinyl acetate; styrene and maleic anhydride; styrene and methyl methacrylate; styrene and ethyl acrylate; styrene and acrylonitrile; methyl methacrylate and ethyl acrylate and the like; polymers and copolymers of conjugated dienes such as polybutadiene, polyisoprene, polychloroprene, styrenebutadiene rubber, ethylene-propylene-diene rubber, acrylonitrile-styrene butadiene rubber and the like; saturated and unsaturated polyesters including alkyds and other polyesters; nylons and other polyamides, polyesteramides; chlorinated polyethers, cellulose esters such as cellulose acetate butyrate, and the like. It is, of course, to be appreciated that all these compositions are characterized by their thermoplastic nature as above defined. In view of the advantages secured by this invention, modifications of the hot melt ink and thermoplastic printing compositions suitable for use herein will become apparent.

A number of thermoplastic or hot melt ink compositions are employed in the operating examples which follow. These and other materials are sometimes identified by trademarks. However, certain of such trademarked materials are defined in *The Condensed Chemical Dictionary,* 8th Edition, Revised by G. G. Hawley, Van Nostrand Reinhold Company, Library of Congress Cat. Card No 75-133848 (1971). Thus, these definitions are incorporated herein by reference. For example, "ELVAX" is a copolymer of ethylene vinylacetate (EVA) by DuPont. A conventional polyethylene based adhesive composition is "Eastabond A-3", manufactured by Eastman Chemical Company. In addition "AC 635" is another polyethylene based composition by Allied Chemical. "Terrell 6100" is a polyester composition and "A-FAX 500" is a polypropylene polymer by Hercules. Polyamides are sold under the trademark "Versalon 1138" by General Mills.

In addition to the variability in polymer formulations, different types of gases may be employed in this screen printing method including air, nitrogen, oxygen, carbon dioxide, methane, ethane, butane, propane, helium, aragon, neon, fluorocarbons such as dichlorodifluoroethane, monochlorotrifluoromethane, or other gases, or mixtures of any of these gases. Such gases can be varied again according to the types of thermoplastic materials employed, conditions and availability of materials. As developed above, such gases can be introduced at low pressure, i.e., ambient or atmospheric up to several pounds per square inch. Various means for melting the adhesive formulations may be used, as exemplified in said U.S. Pat. Nos. 4,059,466; 4,156,754; 4,247,581; 4,301,119 and 4,527,712. Various means for dispersing the gas may be used including but not limited to simple tubes connected to a gas supply, tubes having sintered porous metal tips, perforated baffle plates and motor driven rotary dispersers, to mention a few. Many means for pressurizing and pumping the polymers can be employed. A simple pump can serve as the pressurizing and transfer means. Such means may operate at pressure from about 100 to about 2000 psig, preferably in the case of a molten ink in the area of about 300 to about 1800 psig. Any suitable means may be employed to dispense the hot melt as foams onto the printing screens such as a nozzle disclosed in the above mentioned patents.

The above described hot melt or thermoplastic formulations are employed in the method of this invention usually by pressurization of a stabilized dispersion of gas therein, followed by subsequent dispening to produce a foam. Where it is intended that the hot melt foam may be screen printed in an adhesive pattern, U.S. Pat. No. 4,059,466 assigned to the assignee of this invention may be referred to for an apparatus and method of manufacturing the foam for screen printing. Furthermore, in order to obtain control of the hot melt foaming characteristics, reference is made to U.S. Pat. No. 4,156,754 for the use of surfactants to stabilize the foam to achieve effectiveness and control in screen printing according to this invention. As mentioned in the U.S. Pat. No. 4,156,754, the use of a surfactant ensures the control of essential variables of surface tension, viscosity and gas solubility. The surfactant stabilizes the interphase between the liquid hot melt and the dispersed gas bubbles to achieve the sufficient time stability, and allow pumping, dissolving, flow-transfer, dispensing and foaming of the hot melt ink suitable for use in accordance with the principles of this invention.

OPERATING EXAMPLES

One form of an apparatus for making the hot melt foam composition which is used in the printing method according to this invention is disclosed in U.S. Pat. No. 4,156,754, issued May 29, 1979, and assigned to the assignee of this application. The disclosure of this patent is incorporated herein by reference as demonstrating a typical device for injecting and mixing gas into a molten thermoplastic material. The apparatus disclosed in that patent includes a rotary gas injector mixer disposed in a reservoir or tank. A piston pump is attached to the top of the reservoir and is driven by an air operated or electrical motor. The lower end of the pump is disposed in the molten thermoplastic material and heaters are mounted in the bottom wall of the tank. The injector-mixer has a hollow drive shaft having one end attached to and driven by the motor in a cup-shaped element formed on the opposite end thereof. The motor rotates the shaft as gas from an air supply at atmospheric or several pounds pressure is forced downwardly through the hollow shaft into the cup-shaped element and flows out through a plurality of radial outlet ports formed in the side of the cup. As the gas flows from the ports into the hot melt composition, it forms a stable dispersion of gas bubbles throughout the molten thermoplastic material. As indicated above, surfactants in accordance with U.S. Pat. No. 4,247,581 are employed to provide a stabilized dispersion of the thermoplastic material containing the gas bubbles. This apparatus can be operated for foaming of a polyester resin printing composition.

A number of hot melt foam materials may be employed as inks in accordance with the principles of this invention utilizing the apparatus and method just described. Reference is made to the Table which follows in which a number of thermoplastic materials including ethylene vinylacetate, polyethylene, polyester, polypropylene and polyamide compositions may be employed as hot melt foam inks. The carbon black, fused silica or $TiO_2$ may also be employed as pigments; and other pigments or color agents may be added.

geeing to print the hot melt foam image on a substrate. For instance, a composition delineated above from the above Table in a hot melt state under the temperature conditions set forth for the foam may be applied to a plastic substrate such as a polyethylene terephthalate bottle in order to deposit the desired image upon solidification. Using such a technique, the advantages set forth in the above summary of this invention are achieved.

Other hot melt compositions employing other foaming agents may be employed in the above process. Reference is made to U.S. Pat. No. 4,247,581 Examples 1-7

TABLE

| | Soluble Surfactant | % by wt. | Solid Surfactant | % by wt. | Other Additives | % by wt. | Temp. °F. | Viscosity cps. | Surface Tension dynes/cm. | Foam/liquid ratio | Hydraulic Pressure (psig) | t ½ min. | Foam Density (g/cc) |
|---|---|---|---|---|---|---|---|---|---|---|---|---|---|
| Type | | | | | | | | | | | | | |
| EVA | | 0 | | 0 | | 0 | 350 | 28,000 | 22.4 | | | | 0.37 |
| (Elvax 410) | nonionic | 0.25 | fused silica | 0.1 | | 0 | 350 | 28,000 | | | | 0.34 | |
| | | 0 | | 0 | wax | 30 | 350 | 3,100 | 19.5 | 1.77 | 1100-1200 | 5.9 | |
| | | 0 | fused silica | 0.1 | wax | 30 | 350 | 3,100 | | 1.69 | 1100-1200 | 12.5 | |
| | nonionic | 1.0 | | 0 | wax | 30 | 350 | 3,100 | | 1.98 | 1100-1200 | 5.1 | |
| | nonionic | 1.0 | fused silica | 0.1 | wax | 30 | 350 | 3,100 | | 1.68 | 1100-1200 | 15.0 | |
| | cationic | 1.0 | | 0 | wax | 30 | 350 | 3,100 | | 1.75 | 1200-1300 | 3.6 | |
| Polyethylene | | 0 | | 0 | | 0 | 350 | 2,800 | 23.3 | 1.40 | 1300-1400 | 18.2 | |
| (AC-635) | | 0 | fused silica | 0.1 | | 0 | 350 | 2,800 | | 1.57 | 1300-1400 | 28.1 | |
| | nonionic | 1.0 | | 0 | | 0 | 350 | 2,800 | | 1.44 | 1300-1400 | 36.3 | |
| | nonionic | 1.0 | fused silica | 0.1 | | 0 | 350 | 2,800 | | 1.48 | 1300-1400 | 97.5 | |
| | anionic | 1.0 | | 0 | | 0 | 350 | 2,800 | | 1.53 | 900-1000 | 46.0 | |
| | cationic | 1.0 | | 0 | | 0 | 350 | 2,800 | | 1.42 | 900-1000 | 77.5 | |
| | | 0 | carbon black | 0.1 | | 0 | 350 | 2,800 | | 1.27 | 900-1000 | 97.4 | |
| | | 0 | $TiO_2$ | 0.1 | | 0 | 350 | 2,800 | | 1.46 | 900-1000 | 105.0 | |
| | cationic | 1.0 | fused silica | 0.1 | | 0 | 350 | 2,800 | | 1.75 | 900-1000 | 114.0 | |
| Polyester | | 0 | | 0 | | 0 | 420 | | | 1.90 | 1700-1800 | | 0.43 |
| (Terrell 6100) | nonionic | 1.0 | fused | 0.1 | | 0 | 420 | | | 2.37 | 1700-1800 | | 0.49 |
| Hot Melt Ink Type | | | | | | | | | | | | | |
| Polypropylene | | 0 | | 0 | BHT | 0.3 | 420 | 1,900 | 20.2 | 1.61 | 900-1000 | 55.7 | 0.47 |
| (A-FAX-500) | | 0 | fused silica | 0.1 | BHT | 0.3 | 420 | 1,900 | | 1.60 | 900-1000 | 58.6 | |
| | nonionic | 1.0 | | 0 | BHT | 0.3 | 420 | 1,900 | | 1.69 | 900-1000 | 49.5 | |
| | nonionic | 1.0 | fused silica | 0.1 | BHT | 0.3 | 420 | 1,900 | | 1.62 | 900-1000 | 56.4 | |
| | nonionic | 1.0 | fused silica | 0.1 | BHT | 0.3 | 400 | 3,100 | | 1.68 | 1000-1100 | | |
| Polyamide | | 0 | | 0 | | 0 | 420 | 2,800 | 30.7 | 1.54 | 1400-1500 | 1.0 | 0.39 |
| (Versalon 1138) | nonionic | 1.0 | | 0 | | 0 | 420 | 2,800 | 18.8 | 1.48 | 1400-1500 | 2.0 | |
| | | 0 | fused silica | 0.1 | | 0 | 420 | 2,800 | 20.8 | 1.50 | 1400-1500 | 1.5 | |
| | nonionic | 1.0 | fused silica | 0.1 | | 0 | 420 | 2,800 | 18.3 | 1.54 | 1400-1500 | 3.0 | |

Further details with respect to the above Table, and foam compositions with and without surfactants suitable for use in accordance with this invention, may be had with reference to U.S. Pat. No. 4,156,754 at columns 9 and 10.

The hot melt foam compositions produced in accordance with the above Table are then cast onto a fine mesh metal screen appropriately masked to leave unobstructed the pattern which is to be applied to a substrate. Such screens and patterns including their methods of manufacture as developed are well known in the art and form no specific part of this invention. After the hot melt foam composition is cast onto the metal screen, it is forced through the open areas of the screen by squeefor details of thermosetting resin compositions employing methanol and air foaming agents to produce foams which may be used for screen printing in accordance with the principles of this invention.

Red or blue colored hot melt adhesive with a polyethylene base was obtained from Deco, Inc., Pittsburgh, Pa. (sold under the mark DECO P326). This material was melted at about 350° F. and foamed with $CO_2$ in equipment similar to the type described above. 1% Aersol OT and 0.1% Cab-o-sil surfactants were added to the melt to facilitate foaming to a foam/liquid ratio of about 2.5 to 1. The resulting foamable hot melt was delivered directly onto a 325 mesh stainless steel screen heated above about 200° F. with a logo blanked on it with a Mylar polyester film cut-out. A spreading squeegee of Teflon plastic was used to spread the hot melt across the screen while it was held in contact with a square of corrugated kraft paper board. The result was an excellent quality printed logo in red. It was determined that more foamed adhesive, i.e., about 10% by weight passed through the screen upon comparison with non-foamed hot melt compositions under similar conditions. Thus, it has been demonstrated that the foamed hot melt printing method of this invention produces quality images with speed and transfer of greater amounts of polymeric hot melt inks.

During the course of screen printing with the hot melt foam compositions, it has been observed that the hot melt foam definitely goes through the screen in the foamed state. It has also been empirically determined that by employing the squeegee with the foamed hot melt ink compositions, there is less resistance on the squeegee in forcing the foamed ink compositions through the screen in comparison to hot melt compositions that have not been foamed. Furthermore, where foamed printing has been deposited onto a substrate such as paper, the gas such as $CO_2$ escapes through the paper substrate leaving in effect a bubble-free print. On the other hand, when a substrate which is not as porous as paper is employed, for instance a metal substrate, the printing that is left behind may tend to contain minor amounts of very minute bubbles. In any event, the method of this invention has demonstrated that printed images can be transferred having fine quality. The mechanism of transfer is not completely understood in all cases, however, again one must allow for the possibility that the foam may tend to collapse and be destroyed as it is being transferred through the porous screen. It is highly possible that the transfer mechanism, while it involves transfer of the hot melt in a foamed state, that a certain amount of destruction occurs by reason of the mechanical squeegee action on the foam against the porous screen. Whatever the precise mechanism, it has been empirically demonstrated that the employment of hot melt ink compositions in a foamed state provides a significant number of advantages over known hot melt printing screen techniques as has been developed above.

In view of the above detailed description, it will become apparent to a person of ordinary skill in the art to which the invention pertains and, accordingly, variations may be made without departing from the scope of this invention.

What is claimed is:

1. A method of hot melt screen printing a pattern onto a substrate comprising providing a screen having a desired pattern of porous and nonporous areas adjacent the substrate, heating a nonaqueous thermoplastic to form a hot melt composition of molten thermoplastic, foaming said hot melt composition by introducing a gas to form a hot melt foam composition having a lower viscosity and higher heat retention than the unfoamed hot melt composition, coating onto said screen the hot melt foam composition, and forcing the hot melt foam composition through the porous areas of the screen to form the desired pattern of the composition on the substrate.

2. The method according to claim 1 wherein a squeegee is passed across the screen to force the hot melt foam composition through the porous screen areas.

3. The method according to claim 1 wherein the hot melt foam composition is formed by dispersing gas bubbles in a molten thermoplastic material to form a hot solution, foaming the solution and coating the foamed solution onto the screen.

4. The method according to claim 3 wherein a surfactant is incorporated into the molten thermoplastic material.

5. The method according to claim 1 wherein the hot melt foam composition is formed by dispensing a thermoplastic material containing a foaming agent which volatilizes to introduce said gas and produce a stable foam at atmospheric conditions.

6. The method of claim 5 wherein said foaming agent is a volatile solvent.

7. The method according to claim 1 wherein the hot melt foam composition contains a polymer selected from the group consisting of a polyolefin or copolymer thereof, a polymer of a conjugated diene or copolymer thereof, polyester, polyamide, polyurethane, polyepoxy and cellulose esters.

8. The method according to claim 1 wherein said hot melt foam composition comprises a thermosetting resin.

9. The method according to claim 8 wherein said thermosetting resin is a polyester resin.

10. The method according to claim 1 wherein the screen is heated to assist in the passage of foam melt therethrough.

* * * * *

UNITED STATES PATENT AND TRADEMARK OFFICE

CERTIFICATE OF CORRECTION

PATENT NO. : 4,730,556

DATED : March 15, 1988

INVENTOR(S) : Walter H. Cobbs, Jr.

It is certified that error appears in the above-identified patent and that said Letters Patent is hereby corrected as shown below:

In the body of the TABLE at Columns 7 and 8, line 2, entry "0.34" under the heading "t ½ min." should appear under the heading "Foam Density (g/cc)"

In the body of the TABLE at Columns 7 and 8, line 25, entry "fused" under the heading "Solid Surfactant" should read --fused silica--

Signed and Sealed this

Sixteenth Day of August, 1988

*Attest:*

DONALD J. QUIGG

*Attesting Officer*

*Commissioner of Patents and Trademarks*